US006988721B2

(12) United States Patent
Ingelsten

(10) Patent No.: US 6,988,721 B2
(45) Date of Patent: Jan. 24, 2006

(54) DEVICE FOR STACKING OF SHEETS

(75) Inventor: Leif Ingelsten, Grytåsa Liljebacken (SE)

(73) Assignee: Stralfors AB, Ljungby (SE)

( * ) Notice: Subject to any disclaimer, the term of this patent is extended or adjusted under 35 U.S.C. 154(b) by 177 days.

(21) Appl. No.: 10/363,461

(22) PCT Filed: Sep. 13, 2001

(86) PCT No.: PCT/SE01/01957

§ 371 (c)(1),
(2), (4) Date: Mar. 3, 2003

(87) PCT Pub. No.: WO02/22482

PCT Pub. Date: Mar. 21, 2002

(65) Prior Publication Data

US 2003/0189284 A1 Oct. 9, 2003

(30) Foreign Application Priority Data

Sep. 18, 2000 (SE) ..... 0003303

(51) Int. Cl.
*B65H 31/32* (2006.01)

(52) U.S. Cl. ..... 271/9.13; 271/9.12; 271/218; 270/52.09; 414/791.2; 414/790.8

(58) Field of Classification Search ..... 271/9.12, 271/9.13, 9.11, 218, 197; 270/58.01, 52.09; 414/791.2, 790.8
See application file for complete search history.

(56) References Cited

U.S. PATENT DOCUMENTS 3,507,492 A * 4/1970 Spencer ..... 271/188
4,162,733 A * 7/1979 Wiseman ..... 414/790.4
4,385,757 A * 5/1983 Muller ..... 271/189
4,878,659 A * 11/1989 Besemann ..... 271/218
5,133,543 A 7/1992 Eitel et al.
5,363,728 A 11/1994 Elsner et al.
5,540,370 A 7/1996 Ring
5,570,172 A * 10/1996 Acquaviva ..... 399/403
5,707,058 A 1/1998 Hirth et al.
6,341,773 B1 * 1/2002 Aprato et al. ..... 271/9.13

(Continued)

FOREIGN PATENT DOCUMENTS

| | | | |
|---|---|---|---|
| DE | 4042168 | A1 | 7/1992 |
| DE | 19819736 | C1 | 9/1999 |
| DE | 19819736 | C1 * | 9/1999 |
| GB | 2247450 | A | 3/1992 |
| WO | WO0222482 | A1 | 3/2002 |

*Primary Examiner*—Patrick Mackey
(74) *Attorney, Agent, or Firm*—Tarolli, Sundheim, Covell & Tummino L.L.P.

(57) ABSTRACT

The present invention relates to a device for stacking of sheets. A high-speed printer is provided for printing the sheets or at least one continuous web which is cut to sheets (2). The stacking device is provided to receive sheets in at least one flow (AS1 and/or AS2) thereof to said stacking device and to transfer said sheets (2) in the flow (AS1 and/or AS2) thereof to at least one first stacking table (11*b*) in order to form thereon at least one stack (2A and/or 2B) of sheets (2). At least one second stacking table (11*c*) is provided for displacement in between two sheets (2) in the flow (AS1 and/or AS2) thereof when sheets (2) therein are transferred to the first stacking table (11*b*) such that the second stacking table (11*c*) divides or cuts the flow (AS1 or AS2) of sheets between said two sheets (2) and interrupts the formation of at least one stack (2A and/or 2B) of sheets (2) on the first stacking table (11*b*) and permits formation of at least one stack (2A and/or 2B) of sheets (2) on the second stacking table (11*c*) without interrupting or stopping the flow (AS1 and/or AS2) of sheets (2).

29 Claims, 9 Drawing Sheets

U.S. PATENT DOCUMENTS 6,460,842 B1 * 10/2002 Koelle ..... 270/58.01
6,460,844 B1 * 10/2002 Clifford et al. ..... 271/9.13
6,485,010 B1 * 11/2002 Lamothe ..... 270/52.09
6,695,302 B1 * 2/2004 Lamothe ..... 271/9.12

* cited by examiner

DEVICE FOR STACKING OF SHEETS

FIELD OF THE INVENTION

The present invention relates to a device for stacking of sheets, wherein a high-speed printer is provided for printing the sheets or at least one continuous web which is cut to sheets and wherein the stacking device is provided to receive sheets in at least one flow of sheets to said stacking device and to transfer thin sheets in the flow thereof to at least one first stacking table in order to form at least one stack of sheets on said table.

BACKGROUND OF THE INVENTION

The publication U.S. Pat. No. 5,707,058 defines a stacking device wherein a flow of sheets received on a first stacking table, is interrupted by a second stacking table being moved into said flow and dividing or interrupting it such that said flow of shoots is received by this second stacking table.

SUMMARY OF THE INVENTION

The object of the present invention is to improve prior art stacking devices such that they can operate without interrupting the flow of sheets when the stacking of sheets shall be transferred from one stacking table to another. This is arrived at by providing the device with the characterizing features of subsequent claim 1.

Since the device is provided with said characterizing features, stacking of sheets may be carried through at high speeds and without interruptions when one stacking table is full of sheets and one proceeds to fill another stacking table with sheets.

BRIEF DESCRIPTION OF THE DRAWINGS

The invention will be further described below with reference to the accompanying drawings, in which.

DESCRIPTION OF EXAMPLE EMBODIMENTS

Figure 1:
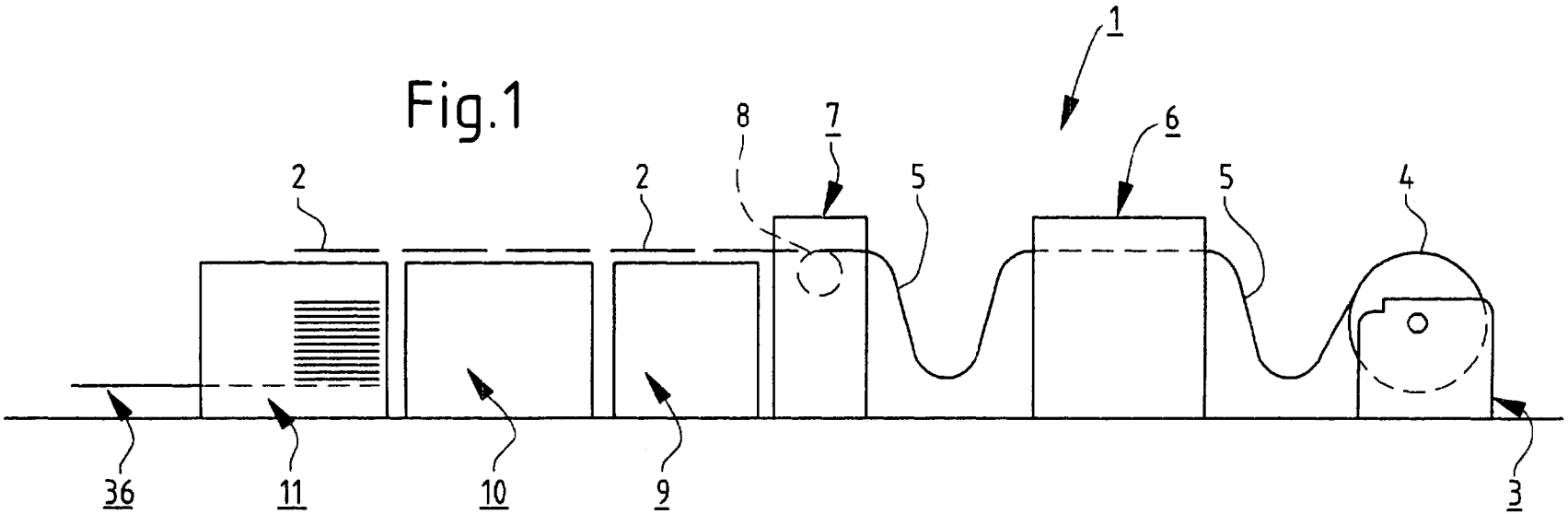
FIG. 1 is a schematic side view of a device according to the invention, forming part of a plant for printing sheets in a high-speed printer.

In FIG. 1 there is illustrated a plant 1 for printing sheets 2, said plant 1 comprising an unrolling stand 3 with a roll 4 of paper or another suitable material which is fed as a continuously running web 5 from said unrolling stand 3 into a high-speed printer 6, e.g. a laser printer, for printing. With high-speed printer 6 is meant a printer which can print the running web 5 when said web passes the printer at high speed, e.g. 2 m/s or even more. After printing the web 5 in the high-speed printer 6, it is brought to run to a cutting device 7 in which the web 5 is cut to sheets 2 by means of knives 8 which can be rotatably mounted. From the cutting device 7, the sheets 2 are fed continuously to a transport device 9 which transports the sheets 2 to a device 10 for lateral movement thereof in opposite lateral directions B, C relative to a main transport direction A (see FIG. 3). The lateral movement of the sheets 2 in lateral directions B, C is carried through for locating the sheets or stacks 2A, 2B of sheets 2 in laterally displaced positions relative to each other in a stacking device 11 into which the sheets 2 are transported from the lateral-movement device 10. Generally, the laterally moved or displaced stacks 2A, 2B shall lie on top of each other and there may be more than two such stacks 2A, 2B lying on top of each other.

The plant 1 may comprise a prior art device (not shown) for locating two webs 5 on top of each other, which are brought to run through the high-speed printer 6 and cut in the cutting device 7 to twin sheets, which are transported by the transport device 9 to the lateral-movement device 10 in which the twin sheets are laterally moved or displaced. Then, the twin sheets are transferred to the stacking device 11, in which said twin sheets are stacked. Eventually, three or four webs can be located on top of each other and treated in the same way.

Figure 3:
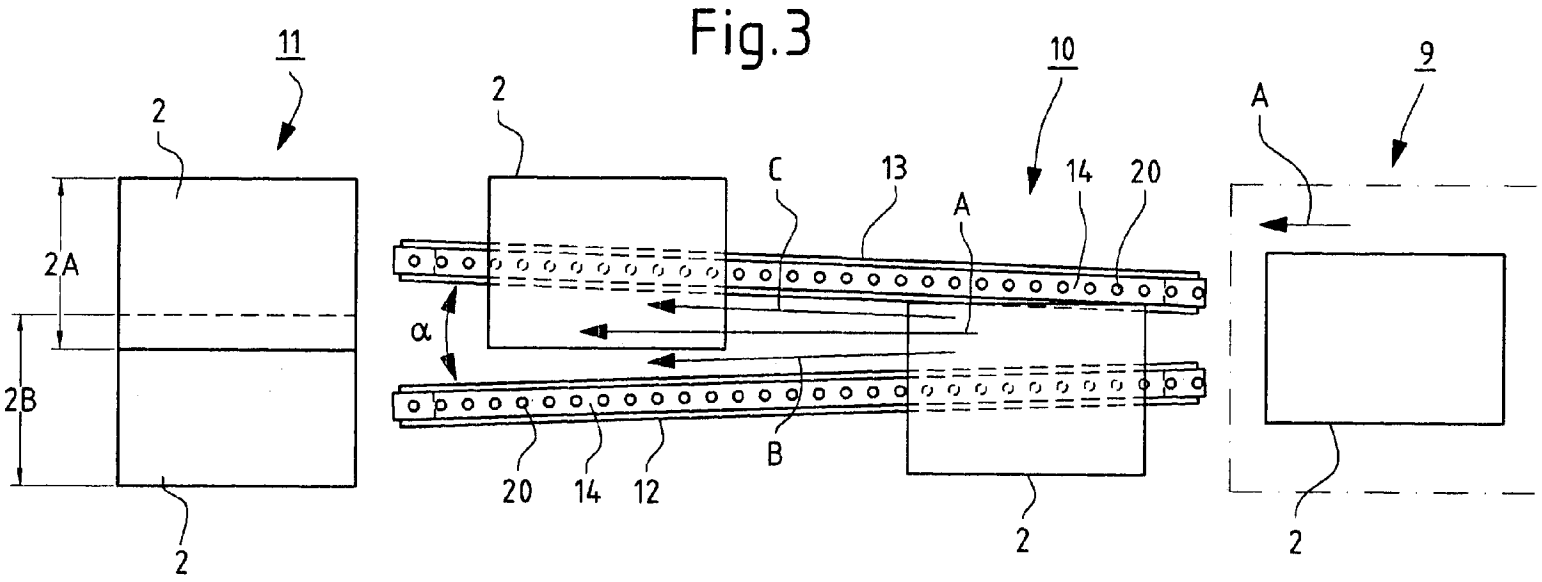
FIG. 3 is a schematic view of a device according to the invention and in a part of the plant of FIG. 1.
Figure 4:
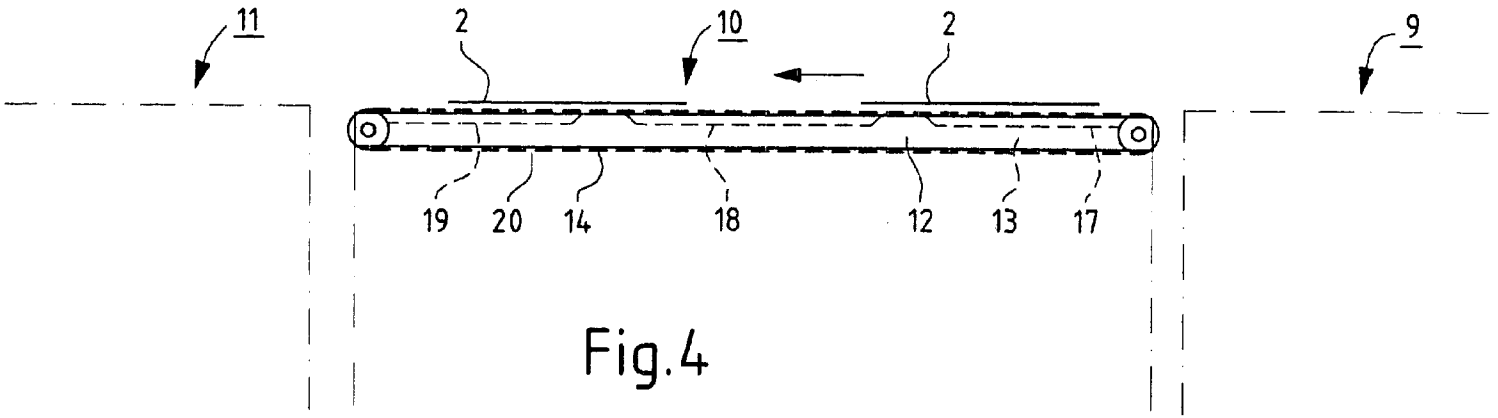
FIG. 4 is a schematic side view of a device according to the invention and in a part of the plant of FIG. 1.
Figure 5:
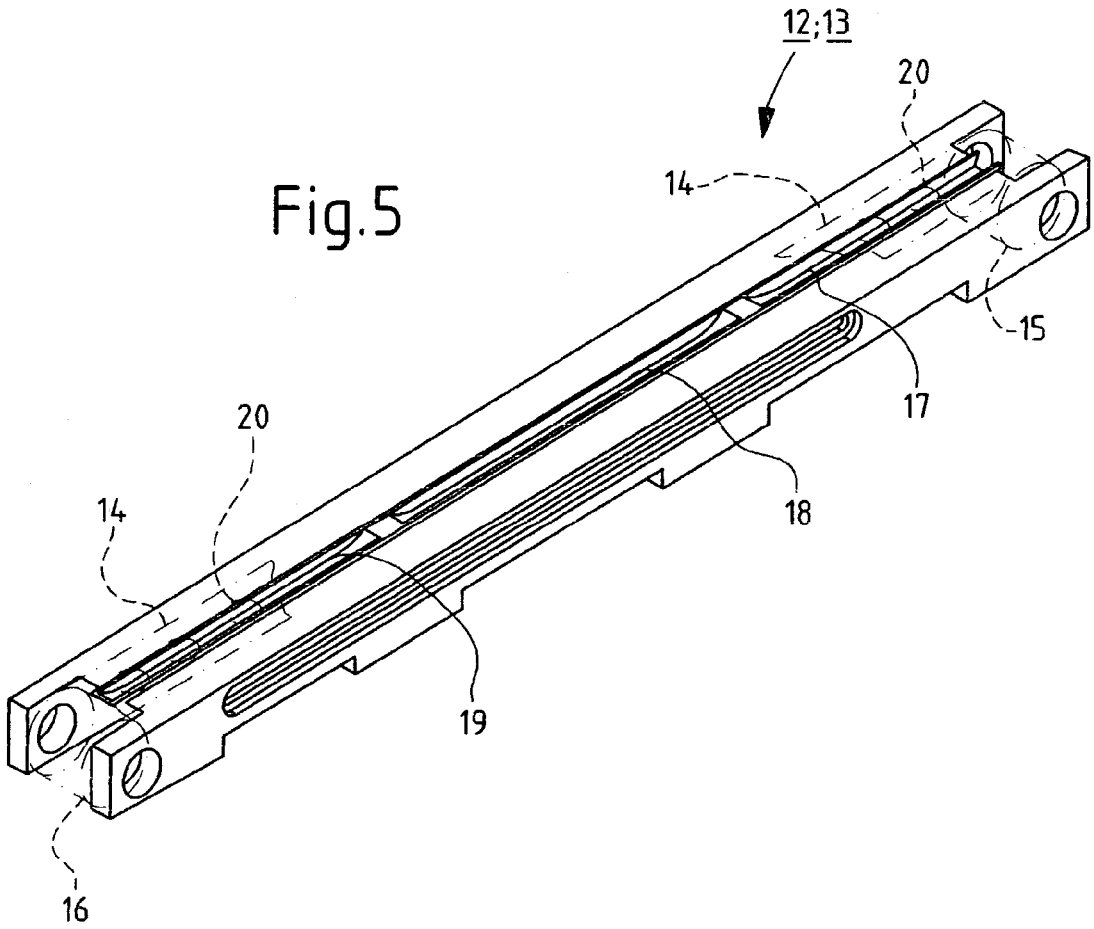
FIG. 5 is a perspective view of a vacuum means forming part of the plant of FIG. 1.

The lateral-movement device 10 includes a vacuum generating device V having at least one pair of vacuum means 12, 13 or another suitable number of pairs of vacuum means, e.g. three pairs (see FIG. 3). At each vacuum means 12 and 13 there is provided an endless conveyor belt 14 which runs about rolls 15, 16 at the opposite end portions of the vacuum means 12 and 13 respectively (see FIG. 5). The conveyor belts 14 are driven or operated in a transport or feed direction by means of a driving device (not shown) and at a speed which is adapted to the speed of the web 5 and the sheets 2. The vacuum means 12, 13 and their conveyor belts 14 are provided diverging somewhat relative to the main transport direction A and the angle $\alpha$ therebetween may lie within a range of 4–8°, which means that the angle between said main transport direction A and each lateral direction B, C is within a range of 2–4°. The angle $\alpha$ however, may lie within a wider range.

Each vacuum means 12, 13 has three vacuum openings 17, 18 and 19 which are located in a row, in line, after each other seen in the respective lateral direction B and C. Another number of vacuum openings than three is also possible. The conveyor belt 14 has a number of vacuum holes 20 which are located in a row after each other in the longitudinal direction of the conveyor belt 14 and these vacuum holes 20 pass over the vacuum openings 17, 18, 19 of the respective vacuum means 12, 13 when the conveyor belt 14 is moved relative to said vacuum means 12, 13.

Each vacuum means 12 and 13 respectively, has a channel system 21 which through a compressed-air line 22 is connected to a compressed-air, generating device 23. The channel system 21 is adapted to guide compressed air to an ejector 24, i.e. a jet pump, in association with each vacuum opening 17, 18, 19. The channel system 21 includes, for each vacuum opening 17, 18, 19 a horizontal channel 25 to which a vertical channel 26 is connected. The channel 26 transforms into a horizontal ejector channel 27 which is directed beyond the lower end of a vertical hole 28 which at the top communicates with the respective vacuum opening 17, 18, 19. The ejector channel 27 runs to a compressed-air outlet 29 through which the compressed air flows out of the ejector 24.

Figure 7:
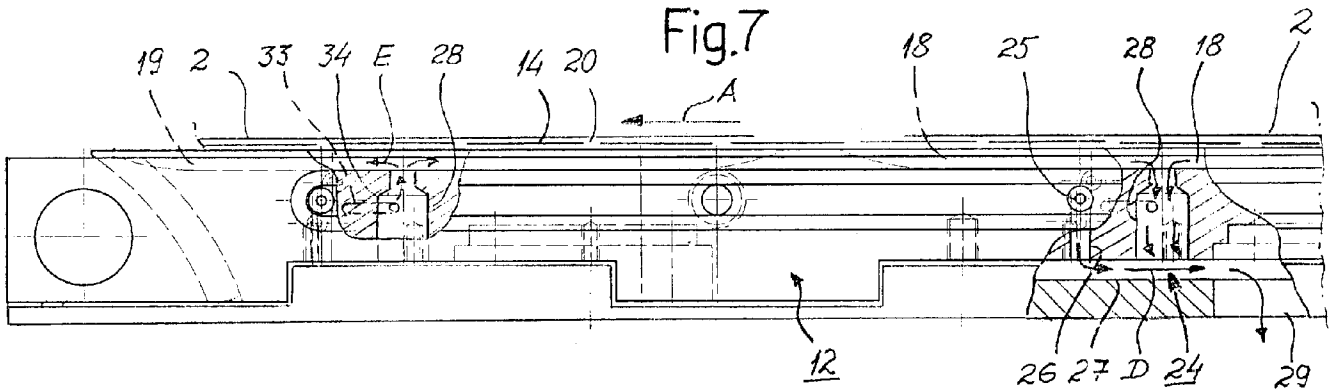
FIG. 7 is a side view of the vacuum means of FIG. 6.
Figure 6:
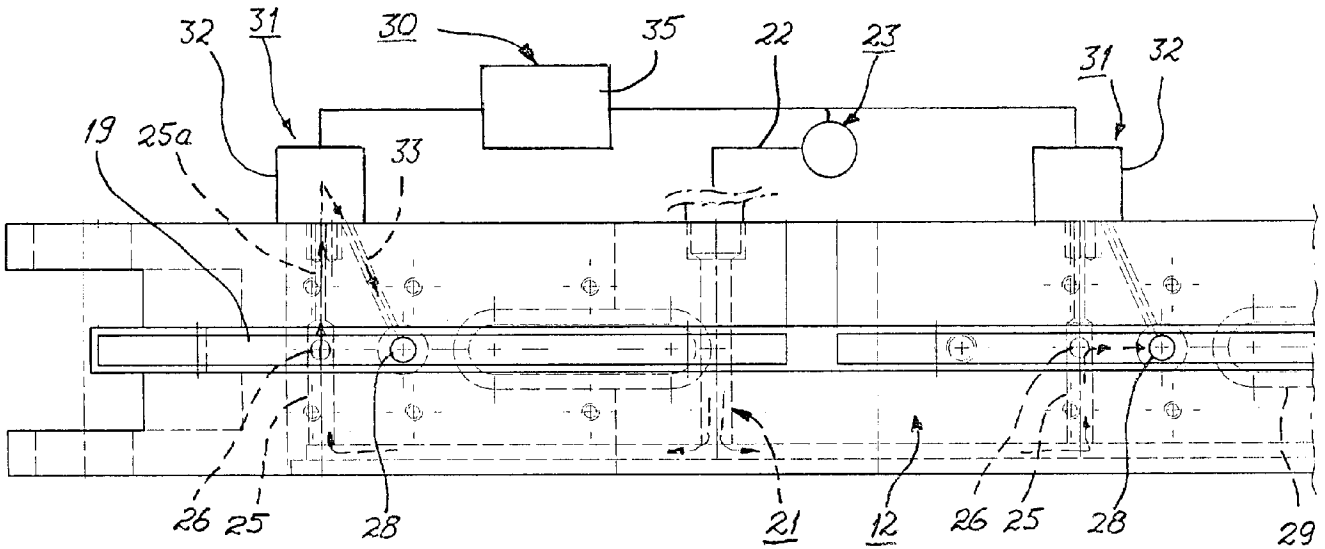
FIG. 6 is a plan view of parts of the vacuum means of FIG. 5.

When the ejector 24 is activated, compressed air is brought to pass through the channels or passages 25, 26 into its ejector channel 27. Since the speed of the jet D of compressed air (FIG. 7) in this ejector channel 27 is high, air will be sucked thereinto from each vacuum opening 17, 18, 19 through the vertical hole 28, whereby a vacuum is generated, i.e. a negative pressure, in each vacuum opening 17, 18, 19 and in the vacuum holes 20 communicating therewith, in the conveyor belt 14.

A vacuum control device 30 is provided to see to that there is either a vacuum in the respective vacuum opening 17, 18, 19 and the vacuum holes 20 in the conveyor belt 14 at said vacuum opening, or to interrupt or withdraw said vacuum. The vacuum control device 30 incorporates a vacuum interrupting or vacuum withdrawing device 31 at each ejector 24 in order to feed compresses air from the compressed-air generating device 23 to the respective vacuum opening 17, 18, 19 for quick and effective withdrawal of the vacuum therein and in the vacuum holes 20 communicating therewith, in the conveyor belt 14. Each vacuum interrupting or vacuum withdrawing device 31 includes a valve 32, preferably an electric valve, through which compressed air can pass from a passage branch 25*a* of the horizontal channel 25 into a horizontal channel 33 having its opening 34 at the top in the vertical hole 28. When the valve 32 is closed, the connection between the channels or passages 25*a*, 33 is closed too, and the compressed air flows through the vertical channel 26 to the ejector channel 27 with ejector effect in the ejector 24 as a result, and thereby generation of a vacuum in the respective vacuum opening 17, 18, 19 and consequently in vacuum holes 20, in the conveyor belt 14, communicating with the vacuum opening in question. If the valve 32 is opened, compressed air will flow through the channels 25*a*, 33 to the vertical hole 28 and immediately interrupt the vacuum therein and thereby in the respective vacuum opening 17, 18, 19 as well as in the vacuum holes 20 in the conveyor belt 14, which communicate with the vacuum opening in question. Preferably, compressed air will in this case generate a certain additional or positive pressure in the vertical hole 28 and in the respective vacuum opening 17, 18, 19 and thereby in the vacuum holes 20 communicating with the vacuum opening in question, in the conveyor belt 14. This is marked with an arrow E in FIG. 7.

The setting of the valves 32 in vacuum generating or vacuum interrupting positions is controlled by means of a vacuum control unit 35 which can be programmed to see to that a vacuum is present in a vacuum opening 17, 18, 19 or not.

The vacuum control device 30 described above can be programmed such that the conveyor belts 14 of the vacuum means 12, 13 alternatingly grip or engage and transport or feed one or more sheets 2 in the different lateral directions B or C in order to, in the stacking device 11, locate the sheets 2 or stacks 2A, 2B of sheets in laterally displaced positions relative to each other. If e.g. laterally displaced stacks 2A, 2B of sheets containing three sheets each shall be formed in the stacking device 11, the vacuum control unit 35 is programmed for control of the vacuum generating device V in the following way. Initially, a vacuum is generated in the vacuum openings 17, 18, 19 of the vacuum means 12 and thereby in the vacuum holes 20 in its conveyor belt 14, but not in the vacuum openings 17, 18, 19 of the vacuum means 13 and thereby neither in the vacuum holes 20 in its conveyor belt 14. When the first sheet 2 is transported or fed to the device 10 for lateral movement, the conveyor belt 14 of the vacuum means 12 will, due to the vacuum in its vacuum holes 20, grip or engage and transport this sheet 2 in the lateral direction B. The following two sheets 2 will also be moved in the lateral direction B to form a stack 2A consisting of three sheets 2 in the stacking device 11. Then, a vacuum is generated in the vacuum openings 17, 18, 19 of the vacuum means 13 instead, and thereby in the vacuum holes 20 in its conveyor belt 14, while the vacuum generation in the vacuum openings 17, 18, 19 of the vacuum means 12 and thereby in the vacuum holes 20 in its conveyor belt 14 is brought to cease or is interrupted. Hereby, the next sheet 2 fed to the device 10 for lateral movement is engaged and transported by the conveyor belt 14 of the vacuum means 13 in the lateral direction C, and so are the following two sheets 2 such that a stack 2B consisting of three sheets 2 and laterally moved relative to the stack 2A is formed in the stacking device 11. This alternating movement laterally is continued until a required number of, relative to each other, laterally moved stacks 2A, 2B have been formed in the stacking device 11.

The vacuum control device 30 can be programmed to bring the vacuum generating device V to generate as well as not to generate or interrupt a vacuum in e.g. the following ways:

A) A vacuum is generated in the first vacuum opening 17 in the first vacuum means 12 and is generated at the same time or is interrupted at the same time in at least one of the following vacuum openings 18, 19 in said first vacuum means 12. A vacuum is not generated or is interrupted at the same time in at least the first vacuum opening 17 of the vacuum openings 17, 18, 19 in the second vacuum means 13.

B) A vacuum is generated in the first vacuum opening 17 in the second vacuum means 13 and it not generated at the same time or is interrupted at the same time in at least one of the succeeding vacuum openings 18, 19 in said second vacuum means 13. A vacuum is not generated at the same time or is interrupted at the same time in at least the first vacuum opening 17 of the vacuum openings 17, 18, 19 of the first vacuum means 12.

C) A vacuum is generated in the first vacuum opening 17 in the second vacuum means 13 and in at least one of the succeeding vacuum openings 18, 19 in said second vacuum means 13. A vacuum is not generated at the same time or is interrupted at the same time in the vacuum openings 17–19 in the first vacuum means 12.

D and E) A vacuum is generated in the first vacuum opening 17 in the first vacuum means 12 and is not generated or is interrupted at the same time in the first vacuum opening 17 in the second vacuum means 13 while it at the same time is generated in any or both of the other vacuum openings 18, 19 in the second vacuum means 13 or vice versa.

F and G) A vacuum is generated in all vacuum openings 17, 18, 19 in the first vacuum means 12 but is not generated at the same time or is interrupted at the same time in all vacuum openings 17, 18, 19 in the second vacuum means 13 or vice versa.

The vacuum control device 30 can be programmed to bring the vacuum generating device V to generate respectively to not generate or interrupt a vacuum in another order depending on the size of the sheets 2 relative to the length of the conveyor belts 14 and/or the feed speed or in dependence of other circumstances.

The vacuum control device 30 can also control the vacuum generating device V such that a vacuum is generated in a vacuum opening 17, 18 or 19 when front portions of a sheet 2 during transport by the conveyor belt 14 reach over this vacuum opening 17, 18 or 19 and such that the generation of vacuum is interrupted when said front portions of the sheet 2 leave their positions over said vacuum opening 17, 18 or 19. Furthermore, the vacuum control device 30 can control the vacuum generating device V such that a vacuum is interrupted or withdrawn in such a vacuum opening 19 within the extension of which rear portions of a sheet 2 are situated when front portions of the sheet 2 are brought to leave the conveyor belt 14 transporting said sheet 2, e.g. when said sheet is turned over by the conveyor belt to the stacking device 11. These functions may alternatively be obtained by a particular shape and/or location of the vacuum openings 17–19.

Two conveyor belts 14 may lie so close to each other that the sheets 2 can have such a size that they during transport on one of the conveyor belts 14, at least during a part of their transport along said conveyor belt 14, move above the other conveyor belt 14. At such a relative location of the conveyor belts 14, it is important that the vacuum control device 30 controls the vacuum to be present only in that conveyor belt 14 which transports the sheets, and that a vacuum is not present in the other conveyor belt 14. Hereby, it is ensured that the transport of the sheets 2 with one conveyor belt 14 is not disturbed by a vacuum in the other conveyor belt 14.

Figure 8:
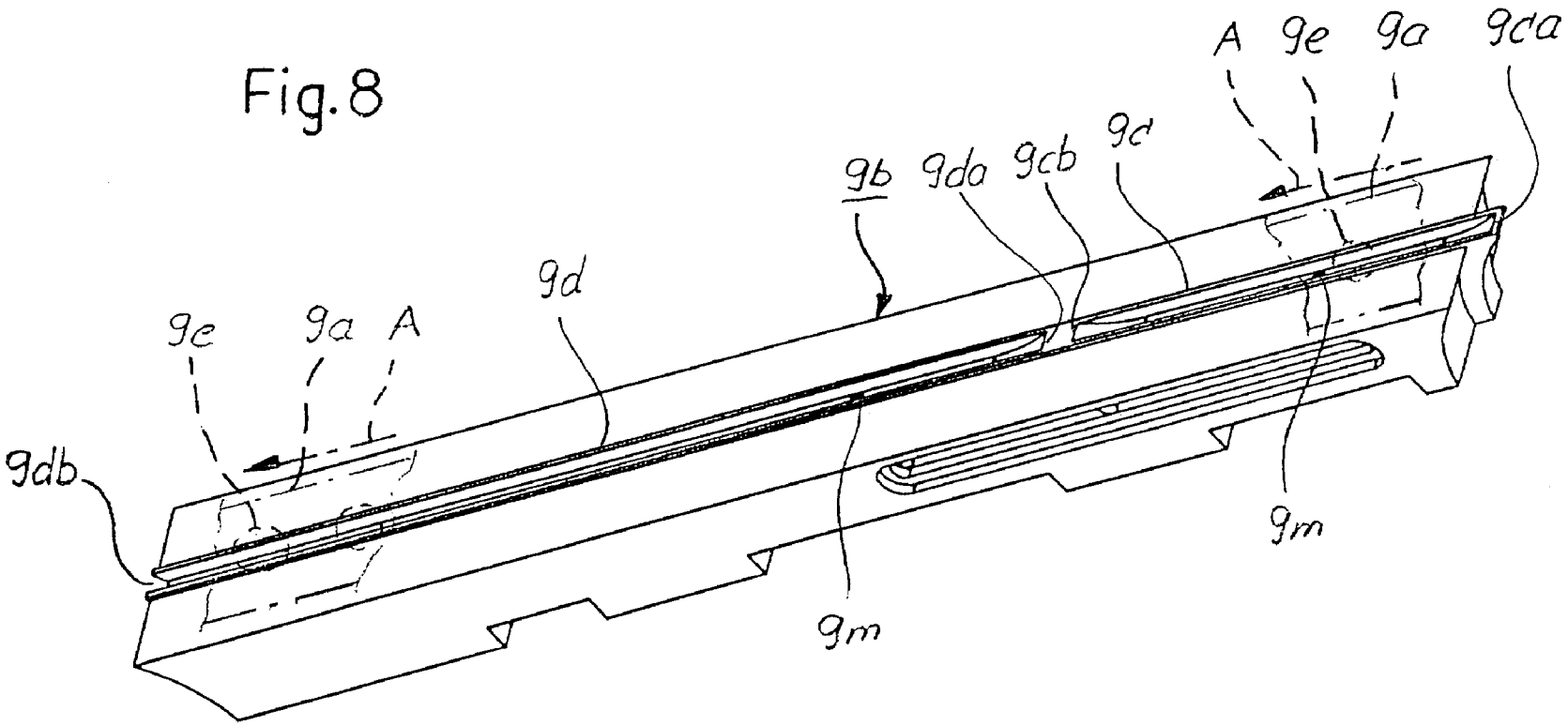
FIG. 8 is a perspective view of another vacuum means forming part of the plant of FIG. 1.
Figure 9:
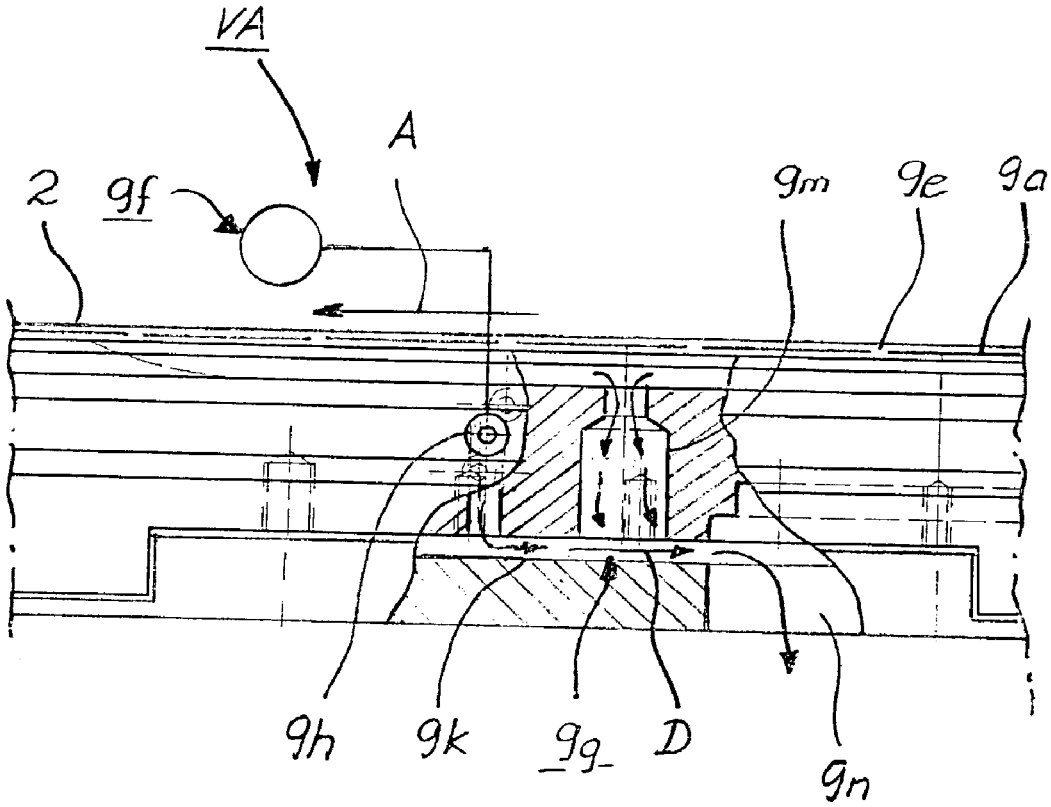
FIG. 9 is a side view, partly in section, of a part of the vacuum means of FIG. 8.

The transport device 9 of the plant 1 includes several, e.g. six conveyor belts 9*a* located beside each other. These conveyor belts 9*a* extend around vacuum means 9*b* illustrated in FIG. 8. Each vacuum means 9*b* has a first vacuum opening 9*c* and a second vacuum opening 9*d* which are elongated and located in a row after each other in the main transport direction A of the sheets 2. The first vacuum opening 9*c* has closed end portions 9*ca* and 9*cb*, while the second vacuum opening 9*d* has a front end portion 9*da*, seen in the main transport direction A, which is closed, but an open rear end portion 9*db*.

The vacuum means 9*b* form part of a vacuum generating device VA which is adapted to generate a vacuum in the vacuum openings 9*c*, 9*d* and thereby in vacuum holes 9*e* provided in the conveyor belts 9*a* such that sheets 2 transported to the transport device 9, are engaged by the conveyor belts 9*a* and maintained in contact therewith for transport through said transport device 9.

The illustrated embodiment of the vacuum generating device VA includes a compressed-air generating device 9*f* which cooperates with an ejector 9*g* at each vacuum opening 9*c*, 9*d*. The ejector 9*g* can be located in the vacuum means 12 and/or 13 which preferably is elongated and about which the conveyor belt 9*a* runs. Hereby, the ejector 9*g* is situated close to the conveyor belt 9*a*, which, inter alia, provides for a simple construction, since there is no need for long channels or passages between the ejector 9*g* and the conveyor belt 9*a*. At the illustrated embodiment, the ejector 9*g* is provided in a vacuum means 12 and/or 13 in the form of an elongated rule including said rolls 15, 16 around which the conveyor belt 9*a* runs. Thus, the compressed-air generating device 9*f* is at each vacuum opening 9*c*, 9*d*, through a channel 9*h*, connected with an ejector 9*g* such that a jet D of compressed air with high speed is formed in an ejector passage 9*k*. This jet D of compressed air generates a vacuum in a vertical hole 9*m* which at the top communicates with each vacuum opening 9*c*, 9*d*, whereby a vacuum, i.e. a negative pressure, is generated also in each vacuum opening 9*c*, 9*d* as well as in vacuum holes 9*e* communicating therewith, in the conveyor belt 9*a*. The compressed air leaves the ejector 9*g* through a compressed-air outlet 9*n*.

There may be a device generating a vacuum at the beginning of a vacuum means 9*b*, seen in the main transport direction A, while it generates less or no vacuum at the end of the vacuum means 9*b*, such that a vacuum is generated in vacuum holes 20 in a conveyor belt 14 running around the vacuum means 9*b* when said vacuum holes 20 pass the beginning of the vacuum means 9*b*, but less vacuum or no vacuum is generated when said vacuum holes 20 pass the end, of the vacuum means 9*b*.

Since the first vacuum opening 9*c* has closed end portions 9*ca*, 9*cb* while the second vacuum opening 9*d* has one open end portion 9*db*, the vacuum effect can be brought to be larger in the first vacuum opening 9*c* than in the second vacuum opening 9*d*. Since the open end portion 9*db* of the second vacuum opening 9*d* is situated at a rear end 9*ba* of the vacuum means 9*b*, i.e. that end which—seen in the main transport direction A—is situated where the sheets 2 leave the conveyor belt 9*a*, the vacuum effect will be less at the rear end portion 9*db* of the vacuum opening 9*d* than at its front end portion 9*da*. Hereby, it is achieved that the vacuum effect is at its largest at the beginning of the vacuum opening 9*d*, but diminish or decrease towards its end portion 9*db*, and hereby, the sheets 2 transported over the vacuum openings 9*c*, 9*d* by the conveyor belts 9*a* are affected by an ever decreasing vacuum until the leave the conveyor belts 9*a*. This effect can be further improved while the vertical hole 9*m* of the vacuum generating device VA at the second vacuum opening 9*d* is located closer to the first end portion 9*da* of said second vacuum opening 9*d* than to its second end portion 9*db*. The vacuum means 9*b* may of course have another number of vacuum openings than two.

Figure 2:
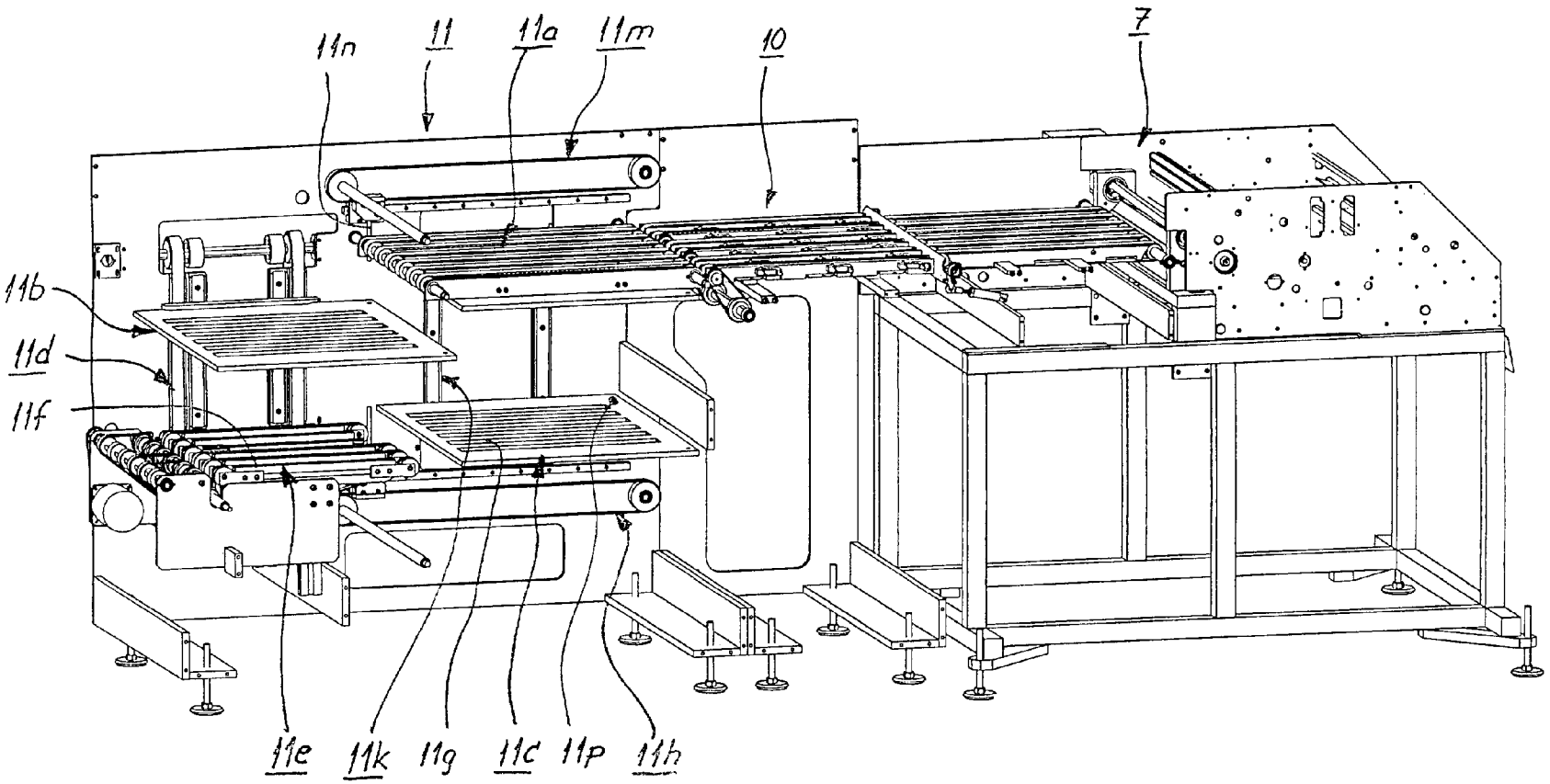
FIG. 2 is a schematic perspective view of a device according to the invention and in a part of the plant of FIG. 1.

At the embodiment illustrated in FIG. 2, the stacking device 11 includes a sheet conveyor 11*a* for receiving laterally moved sheets 2 from the device 10 for lateral movement, and for transferring said sheets to a first or second stacking table 11*b*, 11*c* such that stacks 2A, 2B of sheets according to FIG. 3 are formed thereon. The stacking device 11 further includes a first elevator device 11*d* which can receive one stacking table 11*b* or 11*c* at a time and lower it successively while said stacks 2A, 2B of sheets are formed. The first elevator device 11*d* can lower the stacking table 11*b* or 11*c* to a stack conveyor 11*e* which is adapted to transport the stacks 2A, 2B away from the respective stacking table 11*b*, 11*c*. The stack conveyor 11*e* includes a number of conveyor belts 11*f* and each stacking table 11*b*, 11*c* has elongated holes 11*g* for said conveyors 11*f*. The first elevator device 11*d* can lower each stacking table 11*b*, 11*c* so far relative to the stack conveyor 11*e* that its conveyor belts 11*f* from below will project upwards through the holes 11*g* in the respective stacking table 11*b*, 11*c*. Hereby, stacks 2A, 2B lying on the respective stacking table 11*b*, 11*c* will instead locate themselves on the conveyor belts 11*f* (see FIG. 14), which will feed them away from the stacking table 11*b*, 11*c*.

A lower transfer device 11*h* is provided for moving the stacking tables 11*b*, 11*c* from the first elevator device 11*d* to a second elevator device 11*k*, which is adapted to receive said stacking tables. This may occur when the respective stacking table 11*b*, 11*c* has been released from the stack conveyor 11*e*, and may be carried through by said first elevator device 11*d* raising the stacking table 11*b*, 11*c* somewhat until it goes free from the stack conveyor 11*e*. The second elevator device 11*k* is provided to raise the respective stacking table 11*b*, 11*c* from its cooperation with the lower transfer device 11*h* in upwards direction to a ready position BL, in which it is located just beneath the sheet conveyor 11*a* (see FIG. 11). During this movement, the stacking table 11*b* and 11*c* respectively, has also been brought to cooperate with an upper transfer device 11*m*. This is done by providing the upper transfer device 11*m* with at least one downwardly directed driver 11*n*, which will be inserted into a hole 11*p* in the respective stacking table 11*b*, 11*c* by raising said stacking table to its ready position.

Figure 12:
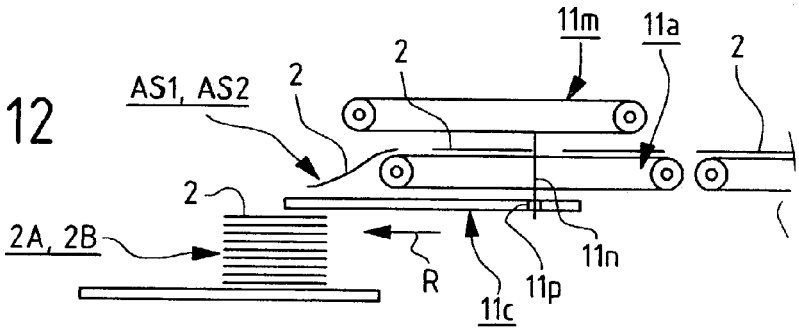
Figure 13:
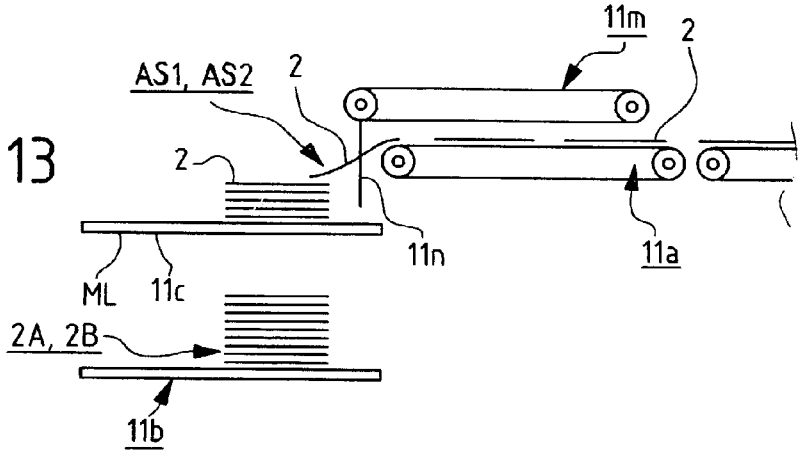

The upper transfer device 11*m* is provided to move the respective stacking table 11*b*, 11*c* with high speed in a direction in parallel or substantially in parallel with the direction in which the sheet conveyor 11*a* transports the sheets 2 (arrow R; FIG. 12) from the ready position BL to a receiving position ML (FIG. 13). During this movement, the respective stacking table 11*b*, 11*c* divides or cuts the flow AS1 and/or AS2 of sheets between two sheets 2 such that the stacking on a stacking table is interrupted and stacking commences on the stacking table which has been moved into said flow AS1 and/or AS2 of sheets.

During said movement of the respective stacking table 11*b*, 11*c* into the flow AS1 and/or AS2 of sheets, the stacking table 11*b*, 11*c* in question will be brought to cooperate with the first elevator device 11*d*. When stacking commences on the stacking table which has been moved into the flow AS1 and/or AS2 of sheets, this stacking table is lowered by the first elevator device 11*d*, and is thereby moved out of cooperation with the driver 11*n* of the upper transfer device 11*m*. The upper transfer device 11*m* may then be reset to receive a stacking table 11*b* which is raised to ready position BL by the second elevator device 11*k*.

Figure 11:
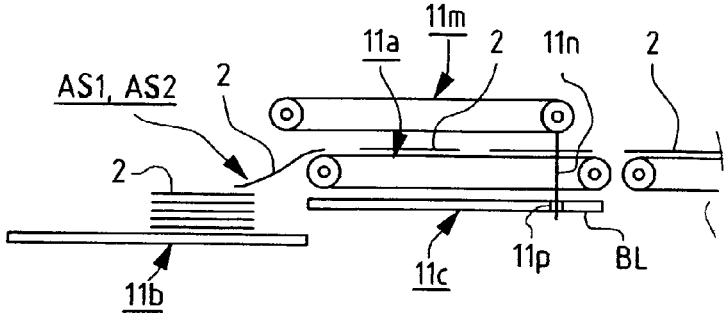
FIGS. 11–14 are schematic side views of parts of a stacking device forming part of the device according to the invention, whereby different parts of the stacking device have different positions.

In FIGS. 11–14, the operation of the stacking device 11 is illustrated in more detail. Thus, FIG. 11 illustrates stacking of sheets 2 on the first stacking table 11*b*, which is located in a receiving position ML and which is gradually lowered. The second stacking table 11*c* is set in its ready position BL and cooperates with the upper transfer device 11*m*.

In FIG. 12 it is shown how the other, second, stacking table 11*c* is moved in the direction of arrow R by the upper transfer device 11*m*, whereby said second stacking table 11*c* is moved or transferred in between two sheets 2 in the flow AS1 and/or AS2 thereof, which flow is then divided such that stacking of sheets 2 on the first stacking table 11*b* is interrupted and stacking of sheets commences on the second stacking table 11*c* without having to interrupt the flow AS1 and/of AS2 of sheets.

In FIG. 13 it is shown how the first stacking table 11*b* is lowered with finished stacks 2A, 2B and how stacking is carried through on the second stacking table 11*c*. The second stacking table 11*c* has been lowered out of engagement with the upper transfer device 11*m*, i.e. it is situated beneath the driver 11*n*.

Figure 14:
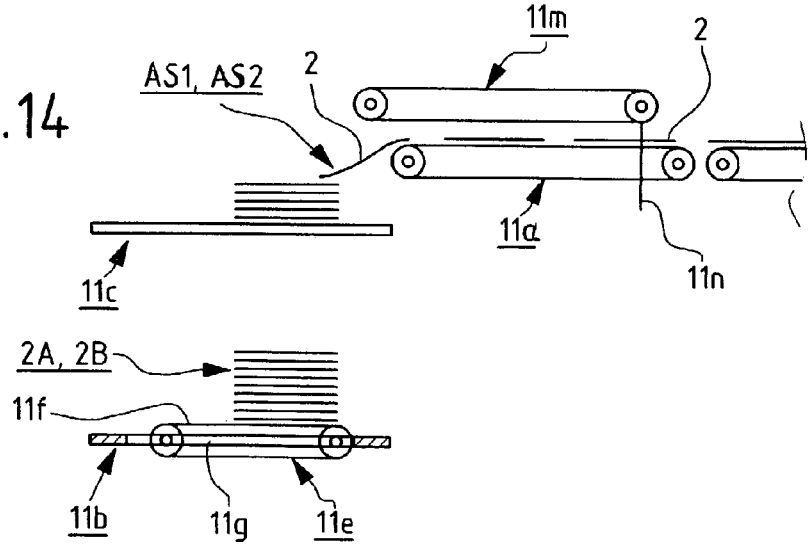

In FIG. 14 it is shown how the first stacking table 11*b* has been lowered relative to the stack conveyor 11*e* such that the stacks 2A, 2B have been placed from above on the conveyor belt 11*f* of the stack conveyor 11*e* for transport thereby of the stacks 2A, 2B away from the first stacking table 11*b*. Additionally, the upper transfer device 11*m* has been reset such that it can be brought to cooperate with the first stacking table 11*b* when said stacking table is raised to the ready position BL.

In this way, both stacking tables 11*b*, 11*c* can be brought to interrupt the flows AS1 and AS2 of sheets alternatingly, such that one of the stacking tables 11*b*, 11*c* always is in receiving position ML for receiving sheets 2, while the other stacking table 11*b*, 11*c* is in a ready position BL for quick transfer or movement into a flow of sheets.

The elevator devices 11*d*, 11*k* and the transfer devices 11*h*, 11*m* may include endless belts for movement of the stacking tables 11*b*, 11*c*, but said devices may of course be designed in other ways. If the upper transfer device 11*m* has a driver 11*n*, said driver may be located on the endless belt of the transfer device 11*m*.

There may of course be more than two stacking tables in the stacking device 11 if necessary.

Figure 10:
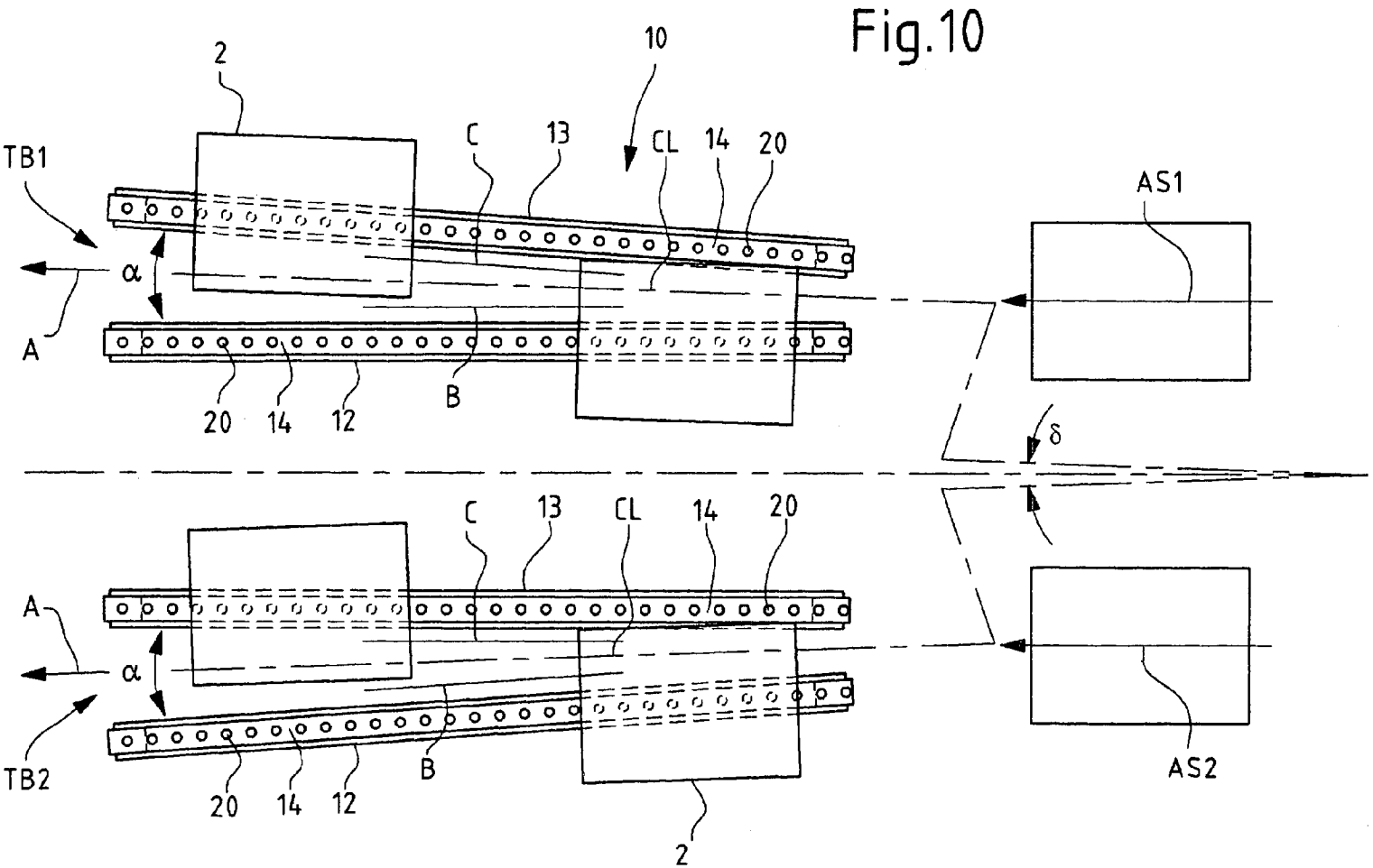
FIG. 10 is a plan view of an alternative lateral-movement device forming part of the device according to the invention.

In FIG. 10 it is illustrated that the transport device 9 can transport or feed sheets 2 in at least two flows AS1 and AS2 of sheets. The sheets 2 in the flow AS1 thereof are transported to a first pair TB1 of conveyor belts and the sheets 2 in the flow AS2 thereof to a second pair TB2 of conveyor belts for lateral movement of the sheets in each flow AS1, AS2 of sheets relative to each other, and thereby form two different groups of stacks beside each other.

The conveyor belts 14 in each pair TB1, TB2 thereof are mounted such that an angle between each conveyor belt 14 and a centre line CL between said conveyor belts are the same or substantially the same. The pairs TB1, TB2 of conveyor belts are located relative to each other such that their centre lines CL—seen in the main transport direction A—diverge. The angle δ between said centre line CL and the main transport direction A is preferably larger than 2° and less than 30°.

Since the pairs TB1, TB2 of conveyor belts are mounted with their centre lines CL making an angle δ relative to each other, it is possible to form two groups of stacks beside each other and if there are more than two pairs of conveyor belts, more than two groups of stacks can be formed beside each other.

By operating both conveyor belts 14 in each pair TB1, TB2 thereof, it is possible to form more such groups of stacks beside each other, where each group of stacks contains several, relative each other laterally displaced stacks 2A, 2B. By operating only one conveyor belt 14 in at least one pair TB1 and/or TB2 of conveyor belts, several groups of stacks can be formed beside each other, where the sheets 2 are not laterally displaced relative each other within the group of stacks.

The device described above may vary within the scope of the appended claims with regard to its operation and construction. As examples of not further described alternatives, it should be mentioned that the vacuum generating device V and/or VA can generate a vacuum in other ways than with compressed air and with other devices than ejectors 24 and 9*g* respectively, and that the vacuum interrupting or vacuum withdrawing device 31 can interrupt the presence of vacuum in other ways than with compressed air and when interrupting or withdrawing a vacuum, this can be carried through in other ways than with compressed air. Also, each vacuum means 12, 13 and 9*b* respectively, may be provided with another number of vacuum openings 17, 18, 19 and 9*c*, 9*d* respectively, than the number shown in the drawings, and said vacuum openings may preferably be elongated and situated in a row, in line with each other. Furthermore, it should be mentioned that the device 10 for lateral movement can be located in another position in the plant 1 than the one shown, it may include another suitable number of conveyor belts 14 than shown and it may include conveyor belts 14 which instead are mounted above a friction plate and which transport and move laterally the sheets on said friction plate.

It should finally be mentioned that the compressed-air generating devices 23 and 9*f* respectively, may be one and the same device.

Also, in the plant 1 there may be more than one transport device 9 and/or may said transport device or transport devices 9 be located in other places in the plant 1. Each transport device 9 may include six or another suitable number of conveyor belts 9*a* with associated vacuum means 9*b*.

What is claimed is:

1. Device for stacking of sheets (2), said device comprising:

a high-speed printer (6) for printing the sheets (2) or at least one continuous web (5) which is cut to sheets (2), and a stacking device (11) for receiving sheets (2) in at least one flow (AS1 and/or AS2) thereof to the stacking device (11) and to transfer the sheets (2) in the flow (AS1 and/or AS2) thereof to at least one first stacking table (11*b*) in order to form thereon at least one stack (2A and/or 2B) of sheets (2), at least one second stacking table (11*c*) being provided for displacement in between two sheets (2) in the flow (AS1 and/or AS2) thereof when sheets (2) therein are transferred to the first stacking table (11*b*) such that the second stacking table (11*c*) divides or cuts the flow (AS1 or AS2) of sheets between the two sheets (2) and interrupts the formation of at least one stack (2A and/or 2B) of sheets (2) on the first stacking table (11*b*) and permits formation of at least one stack (2A and/or 2B) of sheets (2) on the second stacking table (11*c*) without interrupting or stopping the flow (AS1 and/or AS2) of sheets (2), the first stacking table (11*b*) being provided for displacement in between two sheets (2) in the flow (AS1 and/or AS2) of sheets when one sheet is transferred to the second stacking table (11*c*) such that the first stacking table (11*b*) divides or cuts the flow (AS1 or AS2) of sheets between said sheets (2) and interrupts the formation of at least one stack (2A and/or 2B) of sheets (2) on the second stacking table (11*c*) and permits formation of at least one stack (2A and/or 2B) of sheets (2) on the first stacking table (11*b*) without interrupting or stopping the flow (AS1 and/or AS2) of sheets (2), wherein a transfer device (11*m*) is provided to move or transfer one of the stacking tables (11*b*, 11*c*) from a ready position (BL) to a receiving position (ML) in order to cut or divide during this movement the flow (AS1 and/or AS2) of sheets between two sheets (2) and interrupt the formation of at least one stack (2A and/or 2B) of sheets (2) on one other stacking table (11*b*, 11*c*), wherein the transfer device (11*m*) has at least one driver (11*n*) for moving the stacking tables (11*b*, 11*c*), the stacking tables (11*b*, 11*c*), during movement upwards to the ready position (BL), are brought to cooperate with the driver (11*n*), and the stacking tables (11*b*, 11*c*), during movement downwards while stacks (2A and/or 2B) of sheets (2) are formed thereon, are brought out of cooperation with the driver (11*n*), wherein the transfer device (11*m*) includes at least one endless belt for moving the stacking tables (11*b*, 11*c*), the driver (11*n*) is located on the endless belt, and each stacking table (11*b*, 11*c*) has at least one hole (11*p*) for engagement by the driver (11*n*).

2. Device according to claim 1, wherein each stacking table (1*b* and 11*c* respectively), when situated in the ready position (BL), is located under or beneath a sheet conveyor (11*a*) which transports the sheets (2) to a stacking table (11*b* and 11*c* respectively) which is situated in a receiving position (ML), and each stacking table (11*b*, 11*c*) is movable from the ready position (BL) to the receiving position (ML) in a direction parallel or substantially parallel to the direction in which the sheet conveyor (11*a*) transports the sheets (2).

3. Device according to claim 1, wherein each stacking table (11*b*, 11*c*) is lowerable to a stack conveyor (11*e*) which is provided to transport stacks (2A and/or 2B) on the stacking table (11) away from the stacking table (11).

4. Device according to claim 3, wherein each stacking table (11*b*, 11*c*) is lowerable to such position relative to the stack conveyor (11*e*) that conveyor belts (11*f*) forming part thereof can protrude through holes (11*g*) in the respective stacking table (11*b*, 11*c*), whereby stacks (2A, 2B) of sheets (2) on the stacking table (11*b* or 11*c*) will lie on the conveyor belts (11*f*) for transport thereby away from the stacking table (11*b* or 11*c*).

5. Device according to claim 1 for transporting sheets (2) in a plant (1) in which the high-speed printer (6) is included for printing the sheets (2) or the continuous web (5) which is cut into sheets (2), wherein a transport device (9) is provided to transport the sheets (2) in the one flow (AS1 and/or AS2) thereof or the continuous web (5), the transport device (9) includes at least one vacuum device (9*b*) with at least one vacuum opening (9*c*, 9*d*) which communicates with vacuum holes (9*e*) in at least one conveyor belt (9*a*), and a vacuum generating device (VA) is provided to generate a vacuum in the vacuum opening (9*c*, 9*d*) of the vacuum means (9*b*) such that said conveyor belt (9*a*) can engage and transport the sheets (2), the vacuum generating device (VA) comprising a compressed-air generating device (9*f*) from which compressed air is fed or supplied to at least one ejector (9*g*) such that a jet (D) of compressed air therein generates a vacuum in the vacuum opening (9*c*, 9*d*) in the vacuum device (9*b*) and in the vacuum holes (9*e*) in the conveyor belts (9*a*).

6. Device according to claim 5, wherein each vacuum device (9*b*) has at least one vacuum opening (9*d*) with a decreasing vacuum effect—seen in a main transport direction (A) of the sheets (2) or the continuous web (5)—such that suction force on the sheets (2) or the continuous web (5) diminishes when the sheets or web are/is transported along the vacuum opening (9*d*).

7. Device according to claim 6, wherein each vacuum device (9*b*) has at least one vacuum opening (9*d*) with less vacuum effect—seen in the main transport direction (A) of the sheets (2) or the continuous web (5)—at a rear end (9*ba*) of the vacuum device (9*b*) than at portions thereof located in front of the rear end (9*ba*).

8. Device according to claim 7, wherein the vacuum opening (9*d*) has a closed end portion (9*da*) and an open end portion (9*db*), whereby the open end portion (9*db*) is located at the rear end (9*ba*) of the vacuum device (9*b*).

9. Device according to claim 8, wherein the vacuum opening (9*d*) has an end portion (9*da*) which—seen in the main transport direction (A) of the sheets (2) or the continuous web (5)—is located in front of the open end portion (9*db*), and that a hole (9*m*) through which the ejector (9*g*)

communicates with the vacuum opening (9*d*) is located closer to the firstmentioned end portion (9*da*) than to the open end portion (9*db*).

10. Device according to claim 7, wherein the vacuum device (9*b*) has at least two vacuum openings (9*c*, 9*d*), a first vacuum opening (9*c*) having two closed end portions (9*ca*, 9*cb*) and a second vacuum opening (9*d*) having a closed end portion (9*da*) and—seen in the main transport direction (A) of the sheets (2) or the continuous web (5)—an open end portion (9*db*).

11. Device according to claim 7, wherein the vacuum control device (30) is provided to control the vacuum generating device (V) to generate a vacuum in all vacuum openings (17, 18 19) provided in the first vacuum device (12), and the vacuum control device (30) is provided to control the vacuum generating device (V) to simultaneously not generate or interrupt the vacuum in all vacuum openings (17, 18, 19) provided in the second vacuum device (13).

12. Device according to claim 1, wherein a device (10) for lateral movement of sheets (2) is provided such that the sheets (2) or stacks (2A, 2B) of sheets (2) occupy laterally displaced positions relative to each other in the stacking device (11) when the sheets (2) or stacks (2A, 2B) of sheets (2) are located on top of each other in a stacking device (11), the device (10) comprises at least one pair of conveyor belts (14) which are diverging relative to a main transport direction (A) such that the conveyor belts (14) can move sheets (2) laterally in different lateral directions (B, C) relative to a main transport direction (A), and a gripping and contact maintaining appliance is provided such that the conveyor belts (14) can grip or engage sheets (2) and hold them in contact with the conveyor belts (14) for transport thereby, the gripping and contact maintaining device being a vacuum generating device (V) having vacuum devices (12, 13) with vacuum openings (17, 18, 19) located within vacuum holes (20) in the conveyor belts (14), and provided to generate a vacuum in the vacuum openings (17, 18, 19) and vacuum holes (20) so that the conveyor belts (14) can grip or engage and transport the sheets (2), a device for determining which conveyor belt (14) of the two vacuum devices (12, 13) transports the sheets (2) is a vacuum control device (30) which controls the vacuum generating device (V) to alternatingly either generate a vacuum in at least one vacuum opening (17, 18, 19) in one of the vacuum devices (12) or in at least one vacuum opening (17, 18, 19) in the other vacuum device (13) such that one or more sheets (2) is/are engaged and transported or fed by one or the other conveyor belt (14) of the vacuum devices (12, 13).

13. Device according to claim 12, wherein each vacuum device (12, 13) has at least two vacuum openings (17, 18, 19), the vacuum control device (30) is provided to control the vacuum generating device (V) to generate a vacuum in at least a first one (17) of several vacuum openings (17, 18, 19) in at least a first one (12) of the vacuum devices (12, 13), and the vacuum control device (30) is provided to control the vacuum generating device (V) to not generate a vacuum at the same time or withdraw the vacuum at the same time in at least a first one (17) of several vacuum openings (17, 18, 19) in at least a second one (13) of the vacuum devices (12, 13) and vice versa.

14. Device according to claim 13, wherein the vacuum control device (30) is provided to control the vacuum generating device (V) to generate a vacuum in at least a first one (17) of several vacuum openings (17, 18, 19) in the first vacuum device (12), the vacuum control device (30) is provided to control the vacuum generating device (V) to not at the same time generate a vacuum or withdraw the vacuum in at least a first one (17) of several vacuum openings (17, 18, 19) in the second vacuum device (13), and the vacuum control device (30) is provided to control the vacuum generating device (V) to simultaneously generate a vacuum in at least a second vacuum opening (18, 19) in the second vacuum device (13).

15. Device according to claim 14, wherein the vacuum control device (30) is provided to control the vacuum generating device (V) to generate a vacuum in the first vacuum opening (17) in the first vacuum device (12), and not at the same time generate a vacuum or at the same time withdraw the vacuum in at least one other (18, 19) of the vacuum openings (17, 18, 19) in the first vacuum device (12).

16. Device according to claim 14, wherein the vacuum control device (30) is provided to control the vacuum generating device (V) to not at the same time generate a vacuum or interrupt or withdraw the vacuum in the first vacuum opening (17) in the second vacuum device (13) and at the same time generate a vacuum in at least one other (18, 19) of the vacuum openings (17, 18, 19) in the second vacuum device (13).

17. Device according to claim 13, wherein the vacuum control device (30) is provided to control the vacuum generating device (V) to, on one hand, generate a vacuum in a vacuum opening (17, 18 or 19) when the conveyor belt (14) transports a sheet (2) thereto and front portions of the sheet (2) are situated outside the vacuum opening (17, 18, 19), and to, on the other hand, interrupt or withdraw the vacuum in the vacuum opening (17, 18, 19) when the front portions of the sheet (2) have left the area outside the vacuum opening (17, 18 or 19).

18. Device according to claim 13, wherein the vacuum generating device (V) includes at least one compressed-air generating device (23) and at least one ejector (24) at each vacuum device (12, 13), and compressed air from the compressed-air generating device (23) is supplied to the ejector (24) such that a jet (D) of compressed air therein generates a vacuum in the vacuum openings (17, 18, 19) of the vacuum devices (12, 13) and in the vacuum holes (20), communicating therewith, in the conveyor belts (14).

19. Device according to claim 18, wherein a vacuum interrupting or vacuum withdrawing device (31) is provided to supply compressed air from the compressed-air generating device (23) to the vacuum openings (17, 18 and 19 respectively) in the vacuum devices (12, 13) in order to interrupt or withdraw the vacuum in the vacuum openings (17, 18, 19) and in the vacuum holes (20), communicating therewith, in the conveyor belts (14).

20. Device according to claim 18, wherein the vacuum interrupting or vacuum withdrawing device (31) has valves (32) which either can be set in closed positions for guiding compressed air from the compressed-air generating device (23) to the ejectors (24), or in open positions for guiding compressed air to the vacuum openings (17, 18, 19) in the vacuum devices (12, 13).

21. Device according to claim 18, wherein at least one vacuum interrupting or vacuum withdrawing device (31) is provided to not interrupt or withdraw the vacuum in at least a first one (17) of several vacuum openings (17, 18, 19) in the first vacuum device (12), while at least one vacuum interrupting or vacuum withdrawing device (31) is provided to simultaneously interrupt or withdraw the vacuum in at least a first one (17) of a plurality of vacuum openings (17, 18, 19) in the second vacuum device (13).

22. Device according to claim 18, wherein at least one vacuum interrupting or vacuum withdrawing device (31) is provided to interrupt or withdraw the vacuum in at least one vacuum opening (17, 18 or 19) in the vacuum device (12 or 13), but not at the same time interrupt or withdraw the vacuum in at least one other vacuum opening (17, 18 or 19) in the same vacuum device (12 or 13).

23. Device according to claim 18, wherein the compressed-air generating device (23) communicates with a plurality of ejectors (24) at a plurality of vacuum openings (17, 18, 19) in a vacuum device (12, 13).

24. Device according to claim 18, wherein the vacuum interrupting or vacuum withdrawing device (31) is provided to interrupt or withdraw the vacuum in a vacuum opening (19) when rear portions of a sheet (2) pass the area at the vacuum opening (19) and front portions of the sheet (2) are brought to leave the conveyor belt (14).

25. Device according to claim 1, wherein a compressed-air generating device (23, 9*f*) is provided to generate compressed air for ejectors (24, 9*g*) in the device (10) for lateral movement of sheets (2) as well as in the transport device (9) for transport of sheets (2).

26. Device according to claim 1, wherein a cutting device (7) for cutting the continuous web (5) into sheets (2) has rotating knives (8) for cutting the continuous web (5) to sheets (2).

27. Device according to claim 1, wherein the transport device (9) is provided to transport sheets (2) in at least two flows (AS1, AS2) thereof, conveyor belts (14) in a first pair (TB1) thereof are provided to laterally move sheets (2) in one flow (AS1) of sheets (2) and conveyor belts (14) in a second pair (TB2) thereof are provided to laterally move sheets (2) in the other flow (AS2) of sheets, the conveyor belts (14) in each pair (TB1 and TB2 respectively) thereof are mounted such that an angle between each conveyor belt (14) and a centre line (CL) between the conveyor belts (14) is the same or substantially the same, the pairs (TB1, TB2) of conveyor belts (14) are located relative to each other such that their centre lines (CL), seen in a main transport direction (A), diverge for providing groups of stacks located beside each other.

28. Device according to claim 27, wherein both conveyor belts (14) in each pair (TB1 and TB2, respectively) thereof are operable in order to form, with each pair of conveyor belts (14), several groups of stacks with, relative to each other, laterally displaced stacks (2A, 2B) of sheets (2).

29. Device according to claim 28, wherein only one conveyor belt (14) in each pair (TB1 and TB2, respectively) thereof is operable in order to form, by means of each pair (TB1, TB2) of conveyor belts (14), one or more groups of stacks with, relative to each other, not laterally displaced sheets within each group of stacks.

* * * * *